US010026570B2

(12) United States Patent
Niwa et al.

(10) Patent No.: US 10,026,570 B2
(45) Date of Patent: Jul. 17, 2018

(54) VACUUM VALVE

(71) Applicant: Kabushiki Kaisha Toshiba, Tokyo (JP)

(72) Inventors: Yoshimitsu Niwa, Tokyo (JP); Wataru Sakaguchi, Tokyo (JP); Yuki Sekimori, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/295,263

(22) Filed: Oct. 17, 2016

(65) Prior Publication Data

US 2017/0032914 A1 Feb. 2, 2017

Related U.S. Application Data

(63) Continuation of application No. PCT/JP2015/000872, filed on Feb. 23, 2015.

(30) Foreign Application Priority Data

Apr. 17, 2014 (JP) ..... 2014-085371

(51) Int. Cl.
*H01H 33/664* (2006.01)
*H01H 1/06* (2006.01)

(52) U.S. Cl.
CPC ..... *H01H 33/6646* (2013.01); *H01H 33/664* (2013.01); *H01H 1/06* (2013.01); *H01H 33/6642* (2013.01); *H01H 33/6643* (2013.01)

(58) Field of Classification Search
CPC ..... H01H 33/6646; H01H 33/664; H01H 33/6642; H01H 33/6644; H01H 33/6643; H01H 33/6641; H01H 33/66; H01H 1/06
(Continued)

(56) References Cited

U.S. PATENT DOCUMENTS 3,980,850 A * 9/1976 Kimblin ..... H01H 33/6642 200/279
4,117,288 A * 9/1978 Gorman ..... H01H 33/6642 218/129

(Continued)

FOREIGN PATENT DOCUMENTS

CN 101834086 A 9/2010
CN 102187418 A 9/2011

(Continued)

OTHER PUBLICATIONS

International Search Report issued in related Application No. PCT/JP2015/000872, dated Mar. 17, 2015 (9 pages).

(Continued)

*Primary Examiner* — Renee Luebke
*Assistant Examiner* — William Bolton
(74) *Attorney, Agent, or Firm* — Baker Botts L.L.P.

(57) ABSTRACT

A vacuum valve according to embodiments of the present disclosure, comprising: an electrode having a first surface which a hollow part is formed on, which electrode spiral electrode slits which slantingly cross an axial direction are formed on outer circumference of, a conductor fixed on a second surface of the electrode, which second surface is opposite side of the first surface, a contact point having a first concavity which opens to the conductor side, which contact point is fixed on the first surface of the electrode, and a connecting plate whose resistivity is lower than one of the contact point, which connecting plate is disposed inside the first concavity, and connecting plate slits which extend inward from circumference as a starting point are formed on, wherein central axes of the connecting plate slits incline in a rotatory direction of the spiral of the electrode slits.

11 Claims, 8 Drawing Sheets

(58) Field of Classification Search
USPC ..... 218/124, 123, 127, 128, 118, 129
See application file for complete search history.

(56) References Cited

U.S. PATENT DOCUMENTS

| | | | | |
|---|---|---|---|---|
| 4,210,790 | A * | 7/1980 | Kurosawa | H01H 33/6644 218/127 |
| 4,334,133 | A * | 6/1982 | Gebel | H01H 33/6642 200/279 |
| 5,438,174 | A * | 8/1995 | Slade | H01H 33/6644 218/118 |
| 5,804,788 | A * | 9/1998 | Smith | H01H 33/6644 218/129 |
| 6,072,141 | A * | 6/2000 | Slamecka | H01H 33/664 218/127 |
| 6,479,779 | B1 * | 11/2002 | Falkingham | H01H 33/6642 218/128 |
| 2010/0230388 | A1 | 9/2010 | Tak et al. | |
| 2011/0220613 | A1 | 9/2011 | Matsui | |
| 2014/0131316 | A1 * | 5/2014 | Gentsch | H01H 33/6642 218/42 |

FOREIGN PATENT DOCUMENTS

| | | | |
|---|---|---|---|
| EP | 2346061 | A1 | 7/2011 |
| JP | 1-204322 | A | 8/1989 |
| JP | 4-155721 | A | 5/1992 |
| JP | 8-022751 | A | 1/1996 |
| JP | 9-115397 | A | 5/1997 |
| JP | 2002-42617 | A | 2/2002 |
| JP | 2008-262772 | A | 10/2008 |
| JP | 2010-113821 | A | 5/2010 |
| JP | 2014-49353 | A | 3/2014 |
| WO | 2010052992 | A1 | 5/2010 |

OTHER PUBLICATIONS

Extended European Search Report issued in counterpart European application No. 15779643.4, dated Jan. 2, 2018 (8 pages).
Office Action issued in related CN Application No. 201580020041.X, dated Nov. 16, 2017 (9 pages).

* cited by examiner

VACUUM VALVE

CROSS-REFERENCE TO RELATED APPLICATIONS

This application is a By-Pass Continuation of International Application No. PCT/JP2015/000872, filed on Feb. 23, 2015, which is based upon and claims the benefit of priority from Japanese Patent Application No. 2014-085371, filed on Apr. 17, 2014, the entire contents of both of which are incorporated herein by reference.

TECHNICAL FIELD

Embodiments of the present disclosure relate to a vacuum valve.

BACKGROUND

FIG. 15 is a sectional view illustrating an example of a configuration of a conventional vacuum valve. As shown in FIG. 15, in the conventional vacuum valve, Openings on both ends of an insulation vessel 601 made of, for example, ceramics, are sealed with a fixed side sealing metal fitting 602 and a movable side sealing metal fitting 603, respectively. A fixed side conductor 604 passes through the fixed side sealing metal fitting 602, and is fixed to it. A fixed side electrode 605 is fixed to one end of the fixed side conductor 604.

A movable side electrode 606 is disposed to face the fixed side electrode 605. The movable side electrode 606 is fixed to one end of a movable side conductor 607 which passes though an opening of the movable side sealing metal fitting 603, and can move along the opening. A magnetic field (vertical magnetic field) is axially generated by the fixed side electrode 605 and the movable side electrode 606.

One end of elastic bellows 608 is fixed to the intermediate part of the movable side conductor 607. The other end of the bellows 608 is fixed to the movable side sealing metal fitting 603. A cylindrical shield 609 is disposed to surround the electrodes 605, 606 and is fixed to the inside of the insulation vessel 601.

The vacuum valve configured as mentioned above is molded by insulating material, for example a resin, and an insulating part 610 is formed. A conductive part 611 is formed on the outer circumference of the insulating part 610 by application of conductive paint. The conductive paint is, for example, silver paint.

In the above-mentioned vacuum valve, when an operating mechanism not shown is driven, the movable side conductor 607 which is connected to the operating mechanism moves axially. Then, the fixed electrode 605 and the movable electrode 606 can be electrically brought into contact or out of contact with each other. When the fixed electrode 605 and the movable electrode 606 are separated from each other, an arc occurs. However, the arc is diffused throughout contact points of the electrodes 605,606 by the effect of the vertical magnetic field.

SUMMARY

On the other hand, if the distance between the electrodes 605,606 is large, intensity of the vertical magnetic field is lower. It may be difficult for the vertical magnetic field to diffuse the arc throughout the contact points of the electrodes 605,606. If the curvature radius at the ends of the contact points of the electrodes 605,606 is enlarged for electric field relief, the thickness of the contact points becomes thick, and the distance between the electrodes 605,606 and the arc also becomes large. Therefore, the intensity of the vertical magnetic field lowers, and it may be necessary to enlarge the electrodes 605,606 in order to interrupt high electric current.

It is an object of the present invention to provide a vacuum valve capable of improving intensity of a vertical magnetic field which is generated between electrodes of the vacuum valve.

A vacuum valve according to embodiments of the present disclosure, comprising: an electrode having a first surface which a hollow part is formed on, which electrode spiral slits slantingly cross an axial direction are formed on outer circumference of, a conductor fixed on a second surface of the electrode, which second surface is opposite the first surface, a contact point having a first concavity which opens to the conductor side, which contact point is fixed on the first surface of the electrode, and a connecting plate whose resistivity is lower than one of the contact point, which connecting plate is disposed inside the first concavity, and connecting plate slits which extend inward from circumference as a starting point are formed on, wherein central axes of the connecting plate slits incline in a rotatory direction of the spiral of the electrode slits against a line which connects a center point of the connecting plate and a center point of a radial direction on the starting point of the connecting plate slits, as viewed from the contact point side.

DETAILED DESCRIPTION

Embodiments of the present disclosure will be described with reference to the accompanying drawings.

First Embodiment

Figure 1:
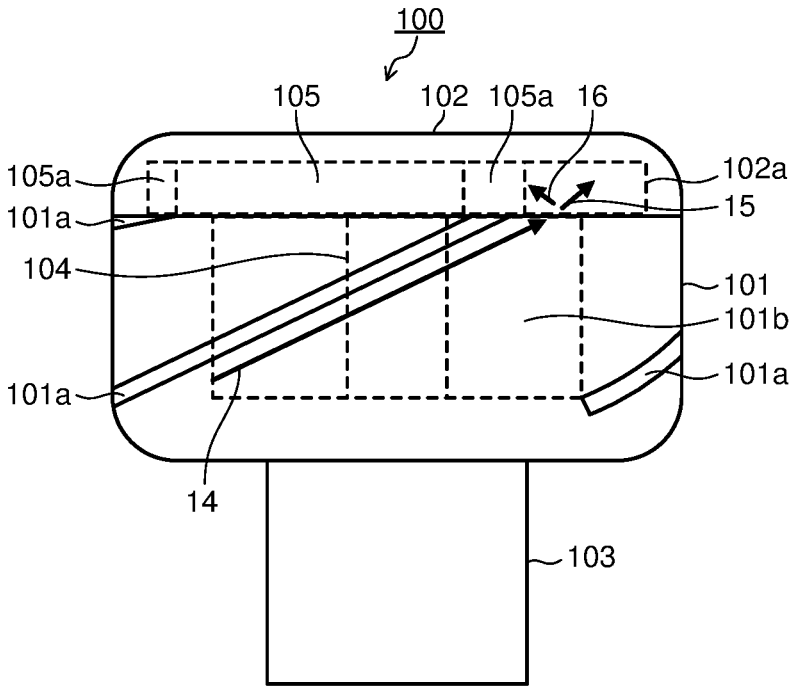
FIG. 1 is a side view illustrating a configuration of an electrode part of a vacuum valve according to a first embodiment.
Figure 2:
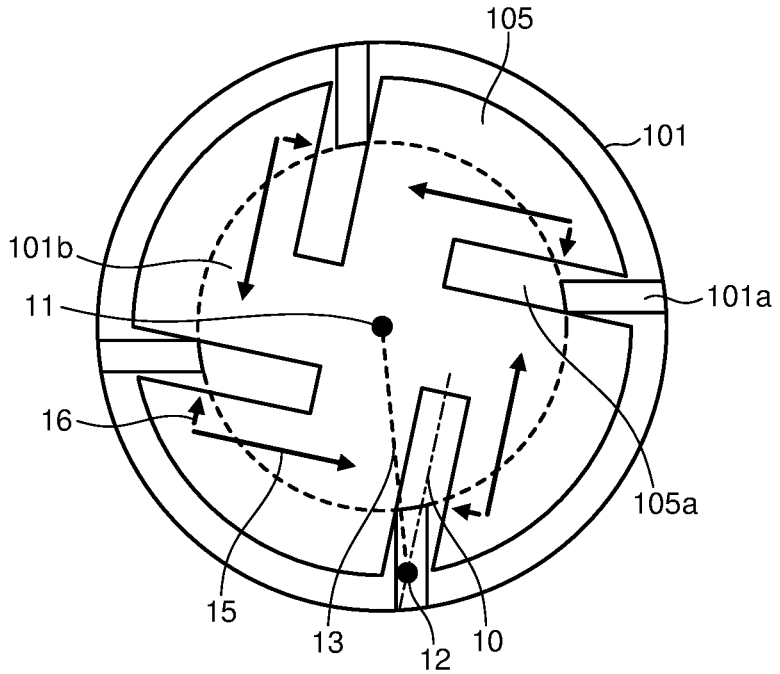
FIG. 2 is a transparent top view of the electrode part of the vacuum valve according to the first embodiment, which is seen from a contact point side.

FIG. 1 is a side view illustrating a configuration of an electrode part of a vacuum valve according to a first embodiment, and FIG. 2 is a transparent top view of the electrode part of the vacuum valve according to the first embodiment, which is seen from a contact point side.

Figure 15:
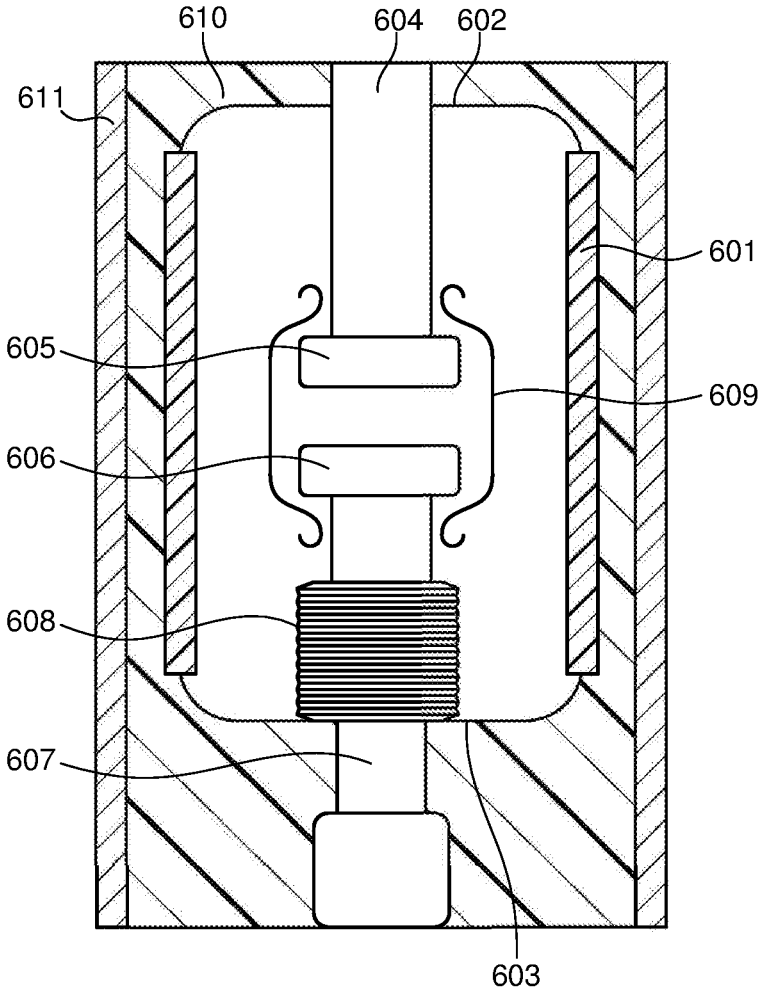
FIG. 15 is a sectional view illustrating an example of a configuration of a conventional vacuum valve.

Since the configuration of the whole vacuum valve is similar to one of a conventional vacuum valve illustrated in FIG. 15, the description of it will be omitted.

Since the configuration of a fixed side electrode part and one of a movable side electrode part are same, only one electrode part 100 will be described in FIGS. 1, 2.

The electrode part 100 of the vacuum valve according to the first embodiment includes an electrode 101, a contact point 102, a conductor 103, a reinforcing member 104 and a connecting plate 105.

The electrode 101 is cup-shape. That is, the electrode 101 has a first surface which a hollow part 101*b* is formed on. The electrode 101 is made of material with high electric conductivity, for example copper. Two or more spiral electrode slits 101*a* which slantingly cross an axial direction of the electrode 101 are formed on the outer circumference of the electrode 101. A first surface of the contact point 102 is fixed on the first surface of the electrode 101. The contact point 102 is made of material which is excellent in the interruption performance, for example an alloy of copper and chromium. A second surface of the contact point 102 can be brought into contact or out of contact with a contact point (not shown) which is disposed to face the contact point 102.

The conductor 103 is fixed on a second surface of the electrode 101, which second surface is opposite the first surface of the electrode 101. Electric current flows into the conductor 103 in its axial direction.

The reinforcing member 104 is disposed inside the hollow part 101*b*. The reinforcing member 104 mechanically supports and fixes the bottom of the hollow part 101*b* and the first surface of the contact point 102. The reinforcing member 104 is made of, for example, insulating material or stainless steel.

The contact point 102 has a first concavity 102*a* on the first surface. The first concavity 102*a* opens to the conductor 103 side. The connecting plate 105 is disposed inside the first concavity 102*a* and is made of material whose resistivity is lower than one of the contact point 102. Such material is, for example, copper.

As shown in FIG. 2, two or more connecting plate slits 105*a* are formed on the connecting plate 105 and extend inward from the circumference of the connecting plate 105 as a starting point. The central axes 10 of the connecting plate slits 105*a* incline in the rotatory direction of the spiral of the electrode slits 101*a* against the line 13 which connects the center point 11 of the connecting plate 105 and the center point 12 of the radial direction on the starting point of the connecting plate slits 105*a*.

In FIG. 1, the electrode slits 101*a* rise to right. Therefore, the rotatory direction of the spiral of the electrode slits 101*a* is defined as "right". That is, the central axes 10 of the connecting plate slits 105*a* incline in right against the line 13 which connects the center point 11 of the connecting plate 105 and the center point 12 of the radial direction on the starting point of the connecting plate slits 105*a*, as viewed from the contact point 102 side. If the electrode slits 101*a* rise to left, the rotatory direction of the spiral of the electrode slits 101*a* is defined as "left", and the central axes 10 of the connecting plate slits 105*a* incline in left against the line 13 which connects the center point 11 of the connecting plate 105 and the center point 12 of the radial direction on the starting point of the connecting plate slits 105*a*, as viewed from the contact point 102 side.

Next, the operation of the vacuum valve of the first embodiment will be described with reference to FIGS. 1, 2.

The first surface of the electrode 101 makes contact with both of the contact point 102 and the connecting plate 105. Since the connecting plate 105 is made of material whose resistivity is lower than one of the contact point 102, the resistance of the connecting plate 105 is small. Therefore, when electric current is interrupted, a lot of electric current which flows through the electrode part 100 flows through the conductor 103, the electrode 101, the connecting plate 105 and the contact point 102 in order. Then, it flows into the contact point (not shown) disposed to face the contact point 102 via an arc which occurs between the contact point 102 and the contact point (not shown).

The direction of electric current 14 which flows from the conductor 13 into the electrode 101 is limited by the electrode slits 101*a*. That is, the electric current 14 passes between the electrode slits 101*a*, as shown in FIG. 1. Therefore, a vertical magnetic field is generated upward in FIG. 1 by circumferential-direction component of the electric current 14 which flows through the electrode 101.

Also, the central axes 10 of the connecting plate slits 105*a* incline in the rotatory direction of the spiral of the electrode slits 101*a* (it is "right" in FIG. 1) against the line 13 which connects the center point 11 of the connecting plate 105 and the center point 12 of the radial direction on the starting point of the connecting plate slits 105*a*.

Therefore, the direction of electric current 15 which flows through the connecting plate 105 is limited by the connecting plate slits 105*a*, as shown in FIG. 2. A vertical magnetic field is also generated upward in FIG. 1 by circumferential-direction component of the electric current 15 which flows through the connecting plate 105.

According to the vacuum valve of the first embodiment as described above, in addition to the vertical magnetic field generated by the electric current 14 which flows through the electrode 101, the same-direction vertical magnetic field is also generated by the electric current 15 which flows through the connecting plate 105. Therefore, intensity of the vertical magnetic field which is generated between the contact point 102 and the contact point (not shown) disposed to face it can improve.

Even if the distance between the electrodes disposed to face each other is large, or the thickness of the contact point 102 is thick, enough vertical magnetic fields are generated. It is possible to control the arc efficiently, so that the arc is diffused throughout the contact point 102. For these reasons, even when high electric current is interrupted, it is not necessary to enlarge either the electrode 101 or contact point 102, and the cost can be reduced.

As shown in FIG. 2, the vacuum valve is configured so that at least a part of the electrode slits 101*a* and the connecting plate slits 105*a* may overlap, as viewed from the contact point 102 side. Therefore, when electric current flows from the electrode 101 into the connecting plate 105, the electric current is prevented from flowing into the direction (electric current 16) by which the intensity of the vertical magnetic field is weakened, and the electric current easily flows into the direction (the electric current 15) by which the intensity of the vertical magnetic field is strengthened.

It is possible to strengthen further the intensity of the vertical magnetic field which is generated between the contact point 102 and the contact point (not shown) disposed to face it.

Second Embodiment

Figure 3:
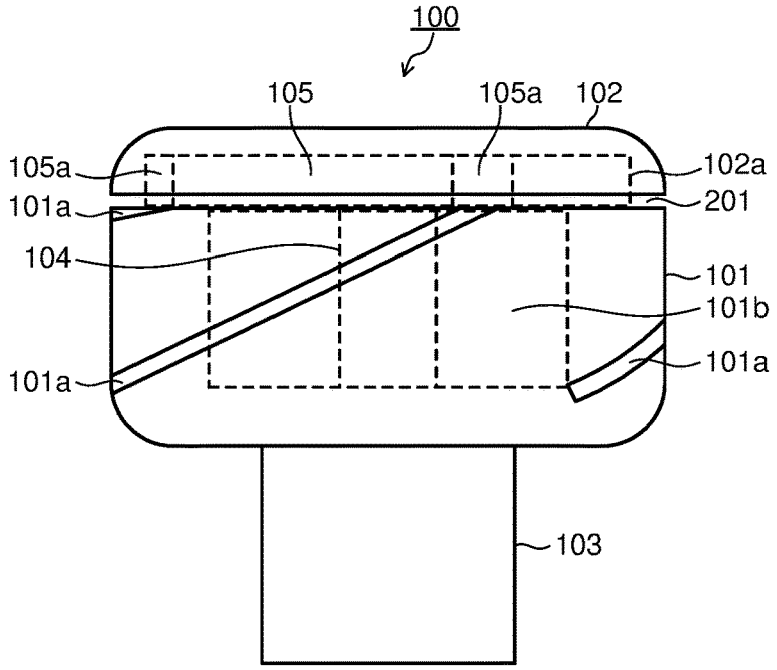
FIG. 3 is a side view illustrating a configuration of an electrode part of a vacuum valve according to a second embodiment.

The configuration of a second embodiment will be described with reference to FIG. 3. The same parts as those of the first embodiment will be designated by like reference symbols with no description made thereon. FIG. 3 is a side view illustrating a configuration of an electrode part of a vacuum valve according to the second embodiment.

The second embodiment differs from the first embodiment in that a gap 201 is formed between the electrode 101 and the contact point 102. The electrode 101 makes contact with only the connecting plate 105.

According to the vacuum valve as configured above, electric current which flows through the electrode 101 from the conductor 103 does not flow into the contact point 102 directly, but all the electric current flows into the connecting plate 105. Therefore, the electric current 15 which flows through the connecting plate 105 increases. It is possible to further strengthen the intensity of the vertical magnetic field which is generated between the contact point 102 and the contact point (not shown) disposed to face it, in addition to the effects obtained in the first embodiment.

Third Embodiment

Figure 4:
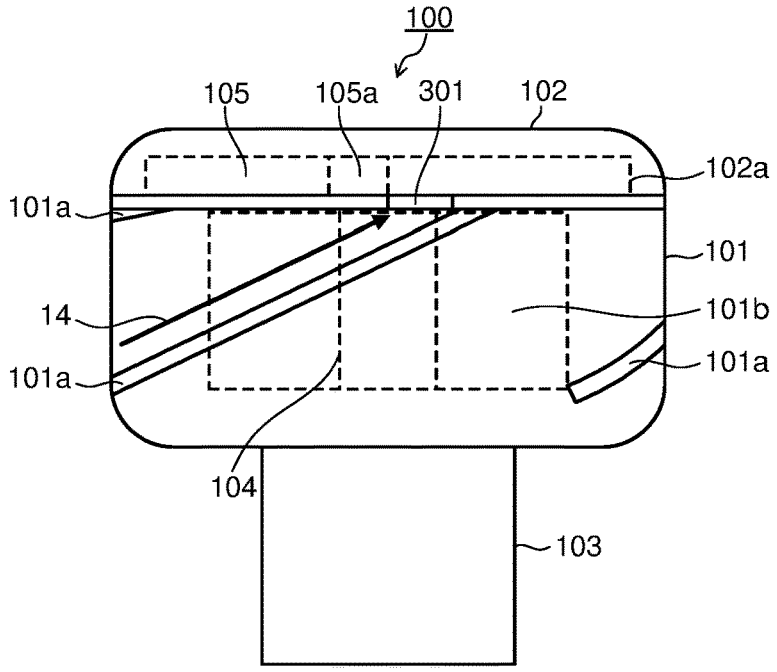
FIG. 4 is a side view illustrating a configuration of an electrode part of a vacuum valve according to a third embodiment.
Figure 5:
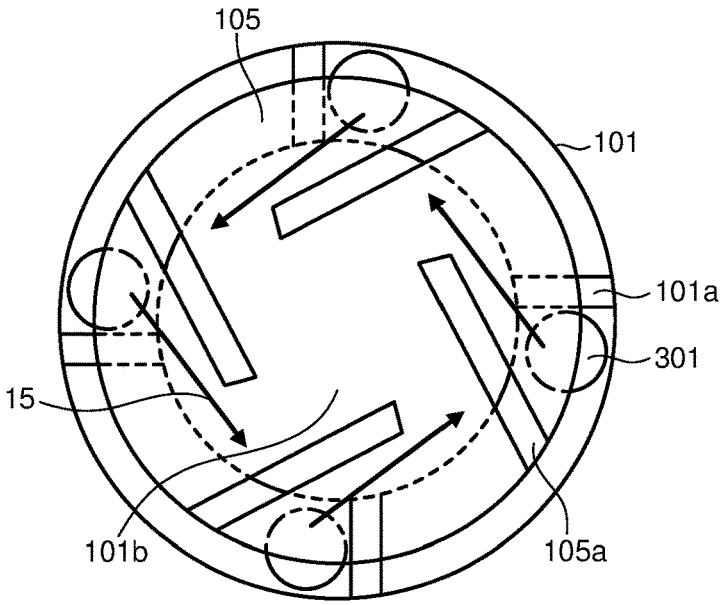
FIG. 5 is a transparent top view of the electrode part of the vacuum valve according to the third embodiment, which is seen from a contact point side.

The configuration of a third embodiment will be described with reference to FIGS. 4, 5. The same parts as those of the first embodiment will be designated by like reference symbols with no description made thereon. FIG. 4 is a side view illustrating a configuration of an electrode part of a vacuum valve according to the third embodiment. FIG. 5 is a transparent top view of the electrode part of the vacuum valve according to the third embodiment, which is seen from a contact point side.

The third embodiment differs from the first embodiment in including contacting portions 301. The contacting portions 301 are formed between the electrode 101 and the contact point 102. That is, the electrode 101 and the contact point 102 do not make contact with each other except the contacting portions 301.

The contacting portions 301 are located at the opposite side to the rotatory direction of the spiral of the electrode slits 101*a* with respect to the electrode slits 101*a* (left side along the circumferential direction with respect to the electrode slits 101*a* in FIG. 5), as viewed from the contact point 102 side. The contacting portions 301 are disposed near the electrode slits 101*a*. The connecting plate slits 105*a* are disposed at the opposite side to the electrode slits 101*a*, as viewed from the contacting portions 301, and near the contacting portions 301.

According to the vacuum valve as configured above, all electric current which flows through the electrode 101 from the conductor 103 flows into the connecting plate 105 via the contacting portions 301. Therefore, the electric current 15 which flows through connecting plate 105 increases. It is possible to further strengthen the intensity of the vertical magnetic field which is generated between the contact point 102 and the contact point (not shown) disposed to face it, in addition to the effects obtained in the first embodiment.

Since the contacting portions 301 are located at the opposite side to the rotatory direction of the spiral of the electrode slits 101*a* with respect to the electrode slits 101*a*, as viewed from the contact point 102 side, and disposed near the electrode slits 101*a*, the circumferential-direction component of the electric current 14 which flows through the electrode 101 increases. It is possible to further strengthen the intensity of the vertical magnetic field which is generated between the contact point 102 and the contact point (not shown) disposed to face it.

Figure 6:
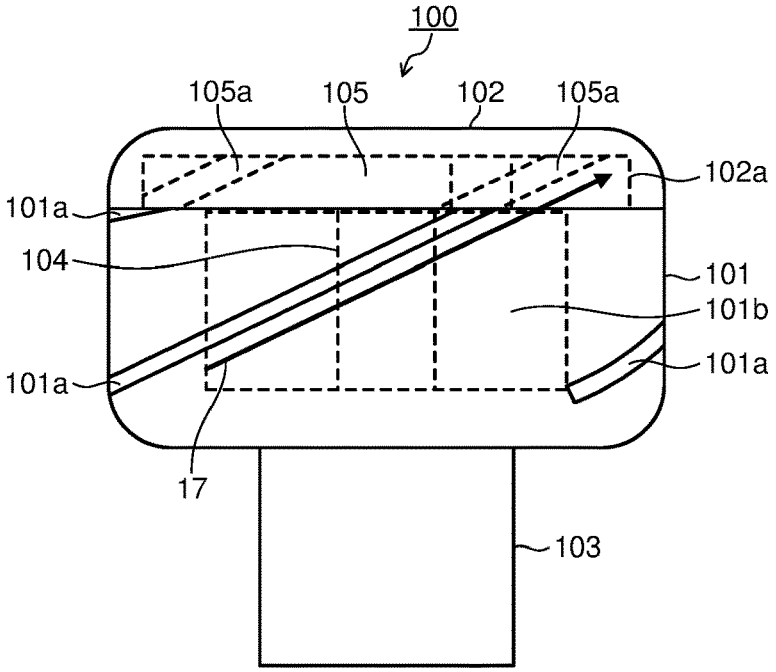
FIG. 6 is a side view illustrating a configuration of an electrode part of a vacuum valve according to a fourth embodiment.

Fourth Embodiment same parts as those of the first embodiment will be designated by like reference symbols with no description made thereon. FIG. 6 is a side view illustrating a configuration of an electrode part of a vacuum valve according to the fourth embodiment.

The fourth embodiment differs from the first embodiment in that the connecting plate slits 105*a* are formed as inclined along the direction of the spiral of the electrode slits 101*a*.

According to the vacuum valve as configured above, the direction of electric current which flows into the connecting plate 105 is limited by the connecting plate slits 105*a* (electric current 17 in FIG. 6). Therefore, the circumferential-direction component of the electric current which flows through the connecting plate 105 increases. It is possible to further strengthen the intensity of the vertical magnetic field which is generated between the contact point 102 and the contact point (not shown) disposed to face it.

Fifth Embodiment

Figure 7:
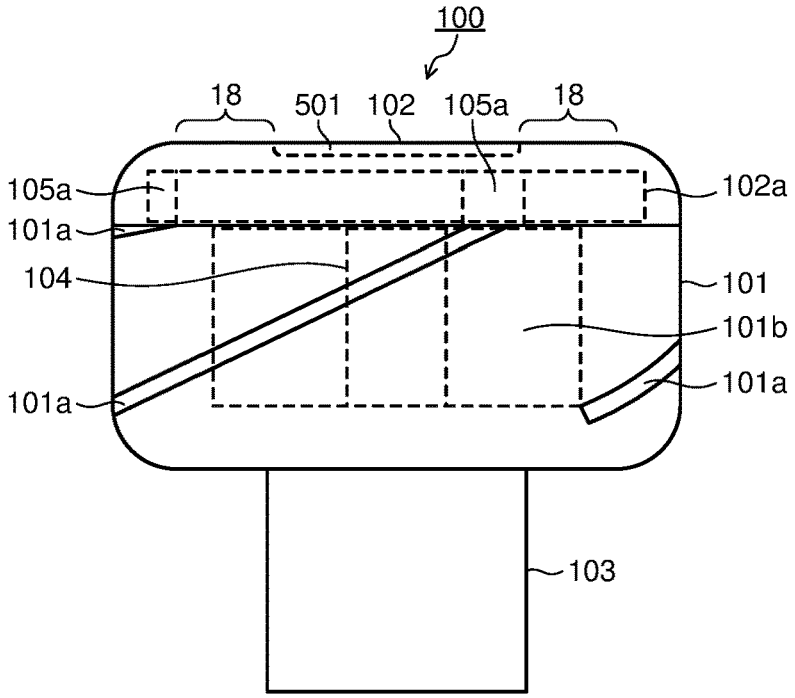
FIG. 7 is a side view illustrating a configuration of an electrode part of a vacuum valve according to a fifth embodiment.
Figure 8:
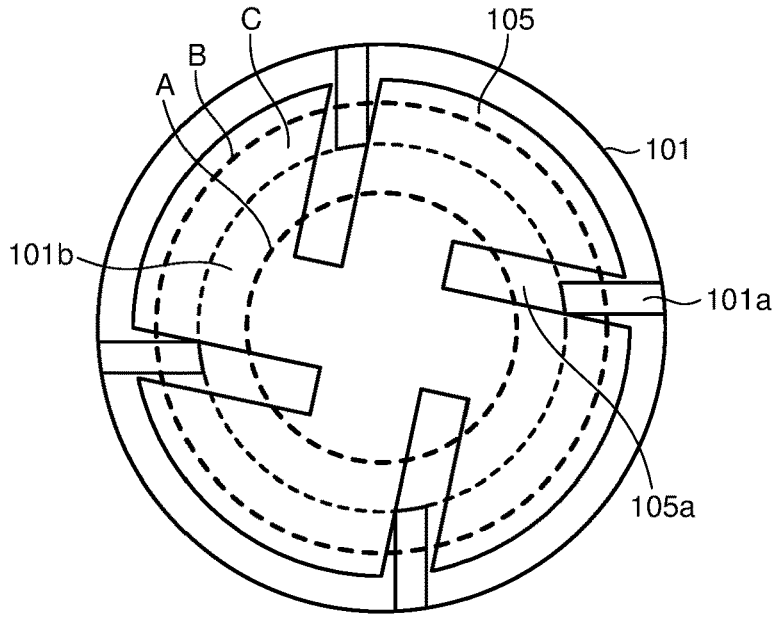
FIG. 8 is a transparent top view of the electrode part of the vacuum valve according to the fifth embodiment, which is seen from a contact point side.

The configuration of a fifth embodiment will be described with reference to FIGS. 7, 8. The same parts as those of the first embodiment will be designated by like reference symbols with no description made thereon. FIG. 7 is a side view illustrating a configuration of an electrode part of a vacuum valve according to the fifth embodiment. FIG. 8 is a transparent top view of the electrode part of the vacuum valve according to the fifth embodiment, which is seen from a contact point side.

The fifth embodiment differs from the first embodiment in that a hollow 501 is formed on the second surface of the contact point 102.

When the contact point 102 is brought into contact with the contact point (not shown) which is disposed to face it, they are brought into contact with each other in the contacting portion 18. That is because the hollow 501 is formed on the second surface of the contact point 102. The arc occurs in the contacting portion 18 when the contact points are separated from each other. The inside of the broken line A corresponds to the hollow 501 in FIG. 8. The area C surrounded with broken line A and broken line B corresponds to the contacting portion 18 in FIG. 8.

The connecting plate slits 105*a* reach to the inside of the broken line A which corresponds to the hollow 501 from the starting point on the circumference of the connecting plate 105. That is, the area C is located between the connecting plate slits 105*a*.

The direction of electric current which flows through the area C of the connecting plate 105 is limited by the connecting plate slits 105*a*. Since the circumferential-direction component of the electric current increases, a high intensity vertical magnetic field is generated in the area C. The arc occurs in the contacting portion 18 corresponding to the area C in which the high intensity vertical magnetic field is generated by the hollow 501. Therefore, the arc can be affected by the vertical magnetic field further.

It is possible to control the arc stably, in addition to the effects obtained in the first embodiment.

Sixth Embodiment

Figure 9:
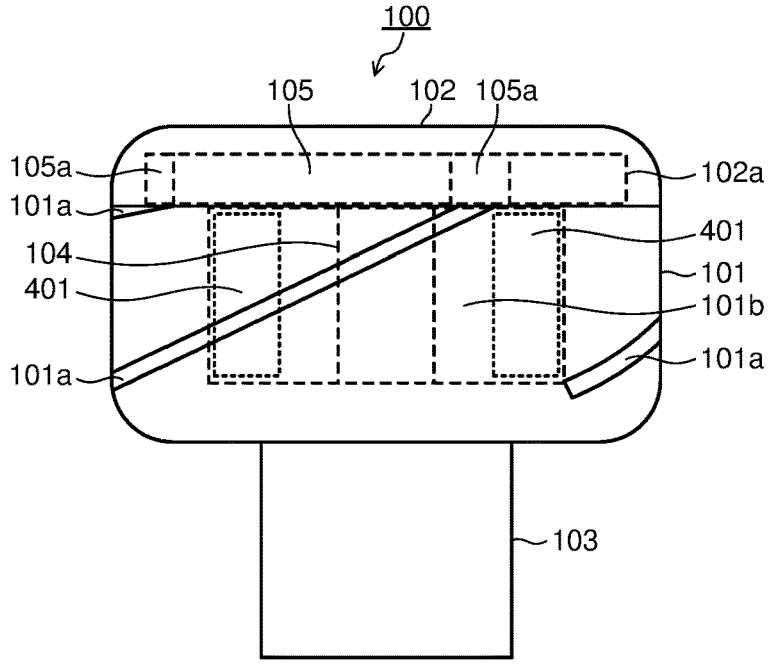
FIG. 9 is a side view illustrating a configuration of an electrode part of a vacuum valve according to a sixth embodiment.

The configuration of a sixth embodiment will be described with reference to FIG. 9. The same parts as those of the first embodiment will be designated by like reference symbols with no description made thereon. FIG. 9 is a side view illustrating a configuration of an electrode part of a vacuum valve according to the sixth embodiment.

The sixth embodiment differs from the first embodiment in including a cylindrical magnetic substance 401.

The magnetic substance 401 is made of, for example pure iron, and disposed inside of the hollow part 101*b* of the electrode 101. Gaps are formed between the magnetic substance 401 and the inside surface of the electrode 101, and between the magnetic substance 401 and the connecting plate 105, respectively, so that they are not electrically connected each other. Instead of forming the gaps, a high resistant substance or an insulator may be disposed between the magnetic substance 401 and the inside surface of the electrode 101, and between the magnetic substance 401 and the connecting plate 105, respectively.

According to the vacuum valve of the sixth embodiment as described above, the magnetic substance 401 which has low magnetic resistance is disposed inside of the hollow part 101*b* of the electrode 101. Therefore, it is possible to further strengthen the intensity of the vertical magnetic field which is generated between the contact point 102 and the contact point (not shown) disposed to face it, in addition to the effects obtained in the first embodiment.

Seventh Embodiment

Figure 10:
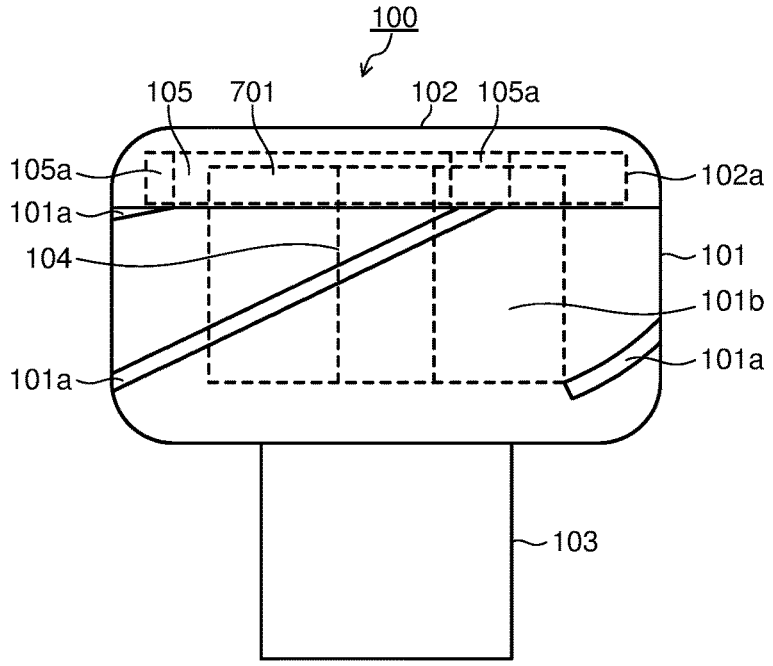
FIG. 10 is a side view illustrating a configuration of an electrode part of a vacuum valve according to a seventh embodiment.

The configuration of a seventh embodiment will be described with reference to FIG. 10. The same parts as those of the first embodiment will be designated by like reference symbols with no description made thereon. FIG. 10 is a side view illustrating a configuration of an electrode part of a vacuum valve according to the seventh embodiment.

The seventh embodiment differs from the first embodiment in including a second concavity 701.

The connecting plate 105 has a second concavity 701 which opens to the conductor 103 side. The size of the radial direction of the second concavity 701 is almost the same (including just the same) as the size of the hollow part 101*b*.

According to the vacuum valve of the seventh embodiment as described above, the connecting plate 105 has the second concavity 701. Therefore, electric current which flows through the connecting plate 105 passes near the contact point 102, that is, the electric current passes near the arc which occurs between the contact point 102 and the contact point (not shown).

For these reasons, the arc can be affected by the vertical magnetic field further, and it is possible to control the arc more stably, in addition to the effects obtained in the first embodiment.

Eighth Embodiment

Figure 11:
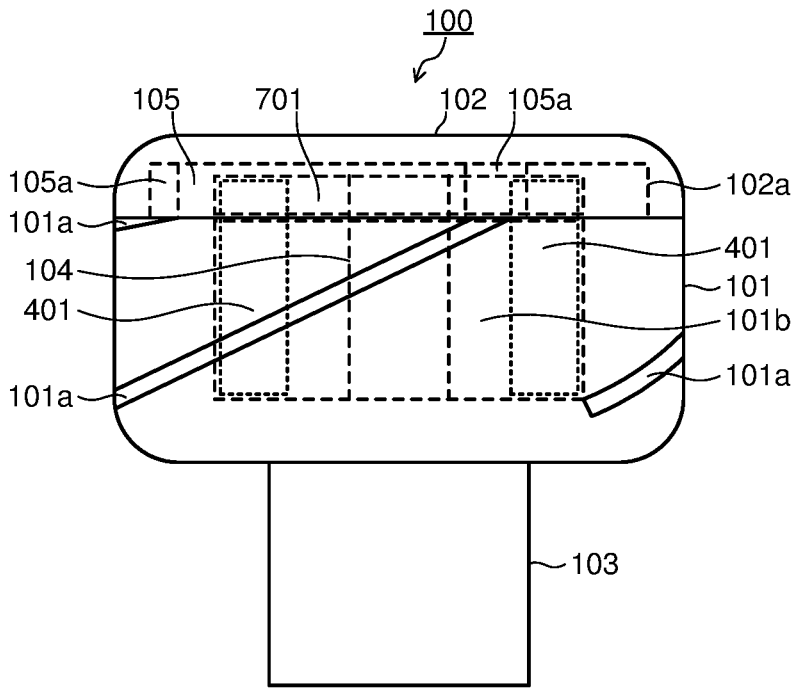
FIG. 11 is a side view illustrating a configuration of an electrode part of a vacuum valve according to an eighth embodiment.

The configuration of an eighth embodiment will be described with reference to FIG. 11. The same parts as those of the sixth embodiment and the seventh embodiment will be designated by like reference symbols with no description made thereon. FIG. 11 is a side view illustrating a configuration of an electrode part of a vacuum valve according to the eighth embodiment.

The eighth embodiment differs from the sixth embodiment and the seventh embodiment in that the vacuum valve has the magnetic substance 401 and the second concavity 701, and the magnetic substance 401 extends toward the inside of the second concavity 701 from the hollow part 101*b*.

According to the vacuum valve of the seventh embodiment as described above, the magnetic substance 401 is disposed near the arc which occurs between the contact point 102 and the contact point (not shown).

Therefore, the arc can be affected by the vertical magnetic field further, and it is possible to control the arc more stably, in addition to the effects obtained in the sixth embodiment or the seventh embodiment.

Ninth Embodiment

Figure 12:
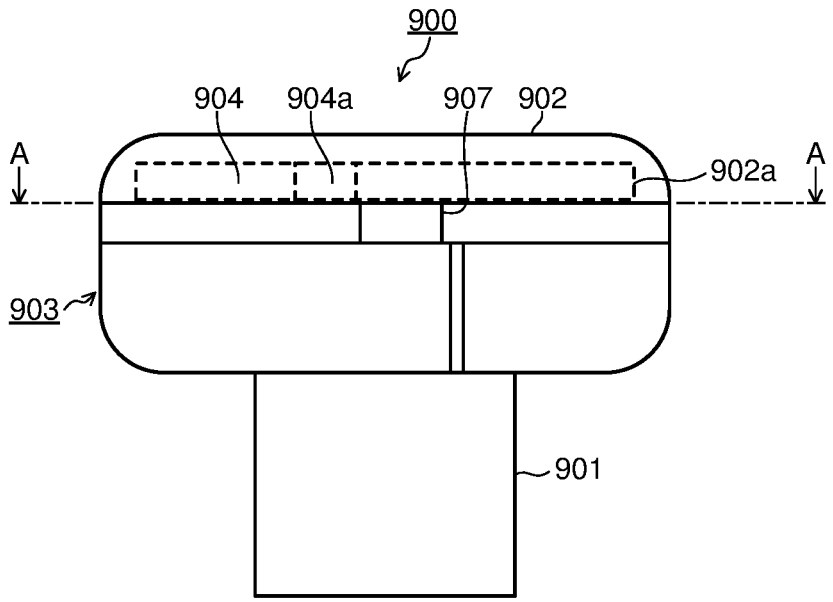
FIG. 12 is a side view illustrating a configuration of an electrode part of a vacuum valve according to a ninth embodiment.
Figure 13:
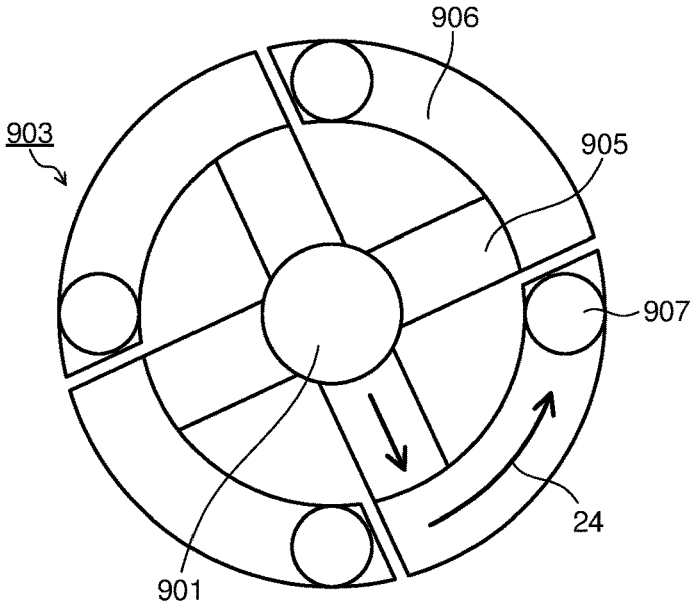
FIG. 13 is a figure viewing from the arrow direction of the A-A line of FIG. 12.
Figure 14:
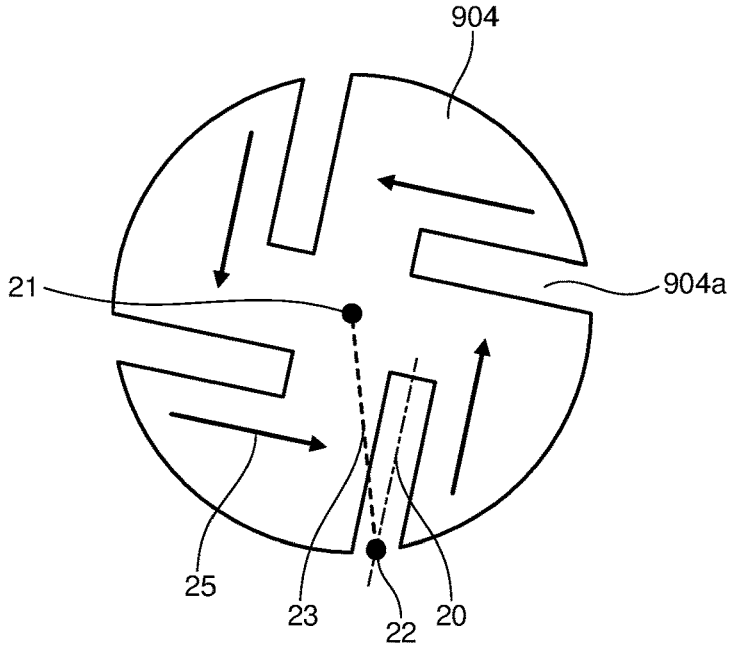
FIG. 14 is a top view of a connecting plate of the vacuum valve according to the ninth embodiment, which is viewed from a contact point side.

The configuration of a ninth embodiment will be described with reference to FIGS. 12 to 14. The same parts as those of the first embodiment will be designated by like reference symbols with no description made thereon. FIG. 12 is a side view illustrating a configuration of an electrode part of a vacuum valve according to the ninth embodiment. FIG. 13 is a figure viewing from the arrow direction of the A-A line of FIG. 12. FIG. 14 is a top view of a connecting plate of the vacuum valve according to the ninth embodiment, which is viewed from a contact point side. In FIGS. 12 to 14, only one electrode part 900 of a pair of electrode parts is described.

The ninth embodiment differs from the first embodiment in the electrode part 900.

The electrode part 900 includes a conductor 901, a contact point 902, an electrode 903, and a connecting plate 904. The electrode 903 includes an arm 905, an arc part 906, and a connecting pin 907.

The arm 905 which extends to an outer side in a vertical direction with respect to an axial direction of the conductor 901 is fixed to an axial end of the conductor 901. The arc part 906 is supported at the tip of the arm 905, and formed in an arc shape along the circumferential direction around the conductor 901.

The connecting pin 907 is formed at the tip of the arc part 906. The arc part 906 is electrically connected with the contact point 902 via the connecting pin 907. The contact point 902 can be brought into contact or out of contact with a contact point (not shown) which is disposed to face it.

The contact point 902 has a first concavity 902*a* which opens to the conductor 901 side. The connecting plate 904 is disposed inside the first concavity 902*a* and is made of material whose resistivity is lower than one of the contact point 902. Such material is, for example, copper.

As shown in FIG. 14, two or more connecting plate slits 904*a* are formed on the connecting plate 904 and extend inward from the circumference of the connecting plate 904 as a starting point. The central axes 20 of the connecting plate slits 904*a* incline in the opposite direction to the rotatory direction of electric current 24 which flows to the arc part 906 from the arm 905 against the line 23 which connects the center point 21 of the connecting plate 904 and the center point 22 of the radial direction on the starting point of the connecting plate slits 904*a*.

In FIG. 13, the rotatory direction of the electric current 24 which flows to the arc part 906 from the arm 905 is counterclockwise, that is, it is "left". Therefore, the opposite direction to the rotatory direction of the electric current 24 which flows to the arc part 906 from the arm 905 is defined as "right" in FIG. 13.

As shown in FIG. 14, the central axes 20 of the connecting plate slits 904*a* incline in right which is the opposite direction to the rotatory direction of the electric current 24 which flows to the arc part 906 from the arm 905 against the line 23 which connects the center point 21 of the connecting plate 904 and the center point 22 of the radial direction on the starting point of the connecting plate slits 904*a*, as viewed from the contact point 902 side.

According to the vacuum valve as configured above, when interception operation is performed, an accidental current or a load current flows into the contact point (not shown) disposed to face the contact point 902 from the conductor 901 via the arm 905, the arc part 906, the connecting pin 907, the connecting plate 904, and the contact point 902.

A magnetic field (vertical magnetic field) is axially generated (upward in FIG. 12) between the contact point 902 and the contact point (not shown) by the electric current 24 which flows through the arc part 904.

The direction of electric current 25 which flows through the connecting plate 904 is limited by the connecting plate slits 904*a*, as shown in FIG. 14. A vertical magnetic field is also generated upward in FIG. 12 by circumferential-direction component of the electric current 25 which flows through the connecting plate slits 904.

According to the vacuum valve of the ninth embodiment as described above, in addition to the vertical magnetic field generated by the electric current 24 which flows through arc part 906 of the electrode 903, the same-direction vertical magnetic field is also generated by the electric current 25 which flows through the connecting plate 904. Therefore, intensity of the vertical magnetic field which is generated between the contact point 902 and the contact point (not shown) disposed to face it can improve.

Even if the distance between the electrodes disposed to face each other is large, or the thickness of the contact point 902 is thick, enough vertical magnetic fields are generated. It is possible to control the arc efficiently, so that the arc is diffused throughout the contact point 902. For these reasons, even when high electric current is interrupted, it is not necessary to enlarge either the electrode 903 or contact point 902, and the cost can be reduced.

While certain embodiments of the present invention have been described above, these embodiments are presented by way of example and are not intended to limit the scope of the present invention. These embodiments can be modified in many different forms. Various kinds of omission, substitutions and modifications may be made without departing from the scope and spirit of the present invention. These embodiments and the modifications thereof fall within the scope and spirit of the present disclosure and are included in the scope of the present disclosure recited in the claims and the equivalent thereof.

EXPLANATION OF REFERENCE NUMERALS

100, 900: electrode part, 101, 903: electrode, 101*a*: electrode slits, 101*b*: hollow part, 102, 902: contact point, 102*a*, 902*a*: first concavity, 103, 901: conductor, 104: reinforcing member, 105, 904: connecting plate, 105*a*, 904*a*: connecting plate slits, 201: gap, 301: contacting portions, 401: magnetic substance, 501: hollow, 601: insulation vessel, 602: fixed side sealing metal fitting, 603: movable side sealing metal fitting, 604: fixed side conductor, 605: fixed side electrode, 606: movable side electrode, 607: movable side conductor, 608: bellows, 609: shield, 610: insulating part, 611: conductive part, 701: second concavity, 905: arm, 906: arc part, 907: connecting pin

What is claimed is:

1. A vacuum valve, comprising:

an electrode having a first surface which a hollow part is formed on, wherein spiral electrode slits are slantingly formed and cross an axial direction on an outer circumference of said electrode;

a conductor fixed on a second surface of the electrode, wherein said second surface is opposite the first surface;

a contact point having a first concavity which opens to a conductor side, wherein said contact point is fixed on the first surface of the electrode; and a connecting plate whose resistivity is lower than the contact point, wherein said connecting plate is disposed inside the first concavity, and connecting plate slits are formed on said connecting plate, the connecting plate slits extending inward from starting points on a circumference of the connecting plate, wherein central axes of the connecting plate slits incline in a rotary direction as same as a rotatory direction of the spiral of the electrode slits against a line which connects a center point of the connecting plate and the starting points, as viewed from a contact point side, wherein the connecting plate has a second concavity which opens to the conductor side, and a size of the second concavity on a line in a radial direction and through a center of the connecting plate is substantially a same as a size of the hollow part on the line.

2. The vacuum valve of claim 1, wherein at least a part of the electrode slits and the connecting plate slits overlap, as viewed from the contact point side.

3. The vacuum valve of claim 1, wherein a gap is formed between the electrode and the contact point, and the electrode makes contact with the connecting plate.

4. The vacuum valve of claim 1, wherein at least one contacting point is formed between the electrode and the contact point.

5. The vacuum valve of claim 1, wherein the connecting plate slits are formed as inclined along a direction of the spiral of the electrode slits.

6. The vacuum valve of claim 1, wherein a hollow is formed on a second surface of the contact point, and the connecting plate slits reach to a location which corresponds to the hollow from the starting point on the circumference of the connecting plate.

7. The vacuum valve of claim 1, further comprising a magnetic member disposed inside the hollow part. 8. The vacuum valve of claim 7, wherein the magnetic member being electrically disconnected from both of the electrode and the connecting plate.

9. The vacuum valve of claim 7, wherein the magnetic member has a first end close to a bottom of the electrode and a second end inside the second cavity.

10. The vacuum valve of claim 9, wherein the magnetic member has a tubular shape.

11. A vacuum valve, comprising:

a conductor into which electric current flows in an axial direction;

an arm extending to an outer side in a vertical direction with respect to the axial direction of the conductor;

an arc part supported at a tip of the arm, and formed in an arc shape along a circumferential direction around the conductor;

a connecting pin formed on the arc part;

a contact point having a concavity which opens to a conductor side, and electrically connected with the arc part via the connecting pin; and a connecting plate whose resistivity is lower than the contact point, which connecting plate is disposed inside the concavity, and connecting plate slits are formed on, the connecting plate slits extending inward from starting points on a circumference of the connecting plate, wherein central axes of the connecting plate slits incline in an opposite direction to a rotatory direction of electric current which flows to the arc part from the arm against a line which connects a center point of the connecting plate and the starting points, as viewed from a contact point side, wherein the connecting plate has a second concavity which opens to the conductor side, and a size of the second concavity on a line in a radial direction and through a center of the connecting plate is substantially a same as a size of a hollow part on the line.

* * * * *